US006513351B2

(12) United States Patent
Clark

(10) Patent No.: US 6,513,351 B2
(45) Date of Patent: Feb. 4, 2003

(54) GATE LATCH

(75) Inventor: Anthony John Clark, Cremorne (AU)

(73) Assignee: D & D Group Pty Limited, Brookvale (AU)

( * ) Notice: Subject to any disclaimer, the term of this patent is extended or adjusted under 35 U.S.C. 154(b) by 0 days.

(21) Appl. No.: 09/765,890

(22) Filed: Jan. 18, 2001

(65) Prior Publication Data

US 2001/0009105 A1 Jul. 26, 2001

(30) Foreign Application Priority Data

Jan. 25, 2000 (AU) ..... PQ5274

(51) Int. Cl.[7] ..... E05B 65/06

(52) U.S. Cl. ..... 70/101; 70/135; 70/190; 292/127

(58) Field of Search ..... 70/77, 101, 102, 70/135, 137, 139, 154, 155, 190; 292/135, 137, 127, 227, 230, 238, 207, 136, 108, 210

(56) References Cited

U.S. PATENT DOCUMENTS 3,433,518 A * 3/1969 Foltz ..... 292/238
3,677,591 A * 7/1972 Waldo ..... 292/221
4,014,192 A * 3/1977 Dillon et al. ..... 70/77
4,378,684 A * 4/1983 Dugan et al. ..... 70/100
4,732,418 A * 3/1988 Crown et al. ..... 292/207
5,024,473 A * 6/1991 McQuade ..... 292/120
5,103,658 A * 4/1992 McQuade ..... 70/77
6,058,747 A * 5/2000 Doyle et al.
6,347,819 B1 * 2/2002 Plaxco ..... 292/336

FOREIGN PATENT DOCUMENTS

DE 3605826 A1 * 8/1987 ..... E05C/9/12

* cited by examiner

*Primary Examiner*—J. J. Swann
*Assistant Examiner*—William S. Fee
(74) *Attorney, Agent, or Firm*—Davis & Bujold, P.L.L.C.

(57) ABSTRACT

A gravity latch for a gate has a front unit having a key operated lock accessible from its front face and a latching tongue mounted in a housing and adapted to capture and retain a striker pin for use with the latch and mounted on a gate, the front unit having a locking element adapted to be displaced by the lock when key operated and a connection arrangement for, connecting to a separate rear unit adapted to be mounted on the opposite side of the gate post. The rear unit has a similar key operated lock and connects through a connection element of an elongate form. A lost-motion connection is provided in association with each lock so that each lock can be actuated independently and either can lock or unlock the latching tongue, and when the tongue is unlocked the rear unit, through a push-button can displace the tongue to release the striker pin.

19 Claims, 3 Drawing Sheets

GATE LATCH

FIELD OF THE INVENTION

The present invention relates to gate latches which can be used for securing in a closed position a gate, door or like structure. More particularly, the invention is concerned with a latch having a latching tongue which is urged to a latching position in which it engages and restrains a latch pin, the tongue being displaceable against the urging force to release the latch pin so that a gate or door may be opened. Usually such a latch is of an automatic closing type whereby when the gate or door is closed, the associated pin strikes the tongue and displaces it against the urging force to permit the pin to be received and then engaged.

BACKGROUND OF THE INVENTION

Generally, the urging force is provided solely by gravity since such an arrangement is reliable and effective and in the case of automatic closing latches, minimises the force needed to strike and displace the tongue whereby the pin is received and retained by the tongue. However, in the context of the present invention, it is not only pure gravity latches to which the invention may be applied but also similar latches which may include an element of biasing e.g. through a spring.

The form of the most common long-standing gravity latch is one often known as a D-latch, whereby a D-shaped tongue is pivotally mounted in an edge region so as normally to fall down with a straight face approximately vertical and behind which a striker pin of the latch assembly engages in a latching position. Automatic latching is provided for by the curved leading face of the latch being adapted to be engaged so as to displace the latch tongue. However, such devices are relatively crude and do not provide any integrated locking function and are not adapted to be actuated from either side of a door or gate.

An important development in the art is that disclosed in the present applicant's prior patent application 78822/98 (now 725095) filed in Australia and the subject of equivalent U.S. Pat. No. 6,058,747. That application disclosed a gravity latch having a housing incorporating a lock accessible to the front of a slim housing for the lock and optionally provided for a remote actuator to permit opening of the latch, providing it is unlocked, from the other side of the gate or door.

However, hitherto there has been available no more sophisticated gravity latch to the best of the applicant's knowledge and with a view to devising improved functionality and more advantageous designs, the present applicant now provides a development which offers advances in the art.

SUMMARY OF THE INVENTION

According to the present invention there is, broadly, provided a latch for gates and doors and having front and rear units adapted to be mounted on opposite sides of a structure associated with a gate or door, (i) the front unit having (a) a housing adapted to be mounted on the structure, (b) a manually displaceable latching tongue displaceably mounted in the housing and adapted to interengage with a striker pin mounted on a gate or door and for holding the striker pin in a closed position to prevent opening of the gate or door, (c) a locking element displaceably mounted in the housing for locking the tongue when in a locking position and displaceable to a retracted position in which the tongue is released, and (d) a key-activated front lock adapted to displace the locking element, (ii) the rear unit having (a) a housing accommodating a key-actuated rear lock and (b) a displaceable element for displacing the latching tongue and, the latch having connection means (a) operable on actuation of either the front lock or the rear lock to displace the locking element between its locking and retracted positions and (b) operable when either of the locks is in an unlocked position to permit a displaceable element of the rear unit to act through part of the connection means to displace the tongue to release the striker pin.

Preferably a rotary action is provided for displacement of the locking element through a lost motion system which permits the displacement of the latching system by either of the locks.

In a preferred embodiment, each lock can be of a quality cylinder-type with a rotatable lost-motion collar attached to the rear of the lock cylinder, the collar having an interior cavity with a cut-out typically of 270°, leaving a 90° wedge such that there is engagement with a first flat bar forming part of the connection means, a portion of the relative rotation between the bar and the collar being free motion which can be taken up and further relative motion causes the collar and bar to move together. A suitable configuration at the respective front and rear locks is provided so that 90° of rotation at either lock provides for lost motion effect whereby the locks can be independently locked and unlocked and thereby independently lock and unlock the locking element which is associated with and displaced by the first flat bar.

Preferably, rotational motion through interconnected gears is provided for rotating the locking element into position to engage the tongue.

In a preferred embodiment, the connection means includes an elongate strip-like connector which interconnects with the rear lock and is displaceable manually towards the front unit whereby a front portion of the connector engages the tongue and displaces it to release the striker pin, this action being possible when either of the locks are unlocked and the arrangement being such that locking of one of the locks displaces the locking element to lock the tongue and prevent the displacement of the tongue and the connector.

An advantageous design is one in which the rear and front locks are not axially aligned but offset and a gear box is used to transmit a rotary motion from the connector to the flat-bar which is axially offset and which extends forwardly to engage in a lost motion device associated with the front lock. Thus, in this embodiment, the flat bar directly displaces the locking element when rotation occurs. Rotation is applied directly from the front lock to the flat bar when lost motion has been taken up and further rotation occurs, and rotation is applied indirectly upon rotation of the connector when the rear lock is rotated and lost motion is taken up.

A significant aspect of the present invention is that it can be incorporated in a durable, secure and highly functional slimline housing adapted to be mounted on a gate post with access to the lock being through the surface of each housing remote from the gate post. Furthermore, at least in preferred embodiments, the connecting means can pass neatly through the gate post or other structure and preferably all that is needed is to bore a circular hole of the appropriate diameter in the appropriate location. This facilitates accurate and easy fitting without high trade skills or special equipment. No morticing is required for the structure.

Preferably, the rear unit housing incorporates a push button in which the rear lock is mounted, the push button being spring-biased to an outer position. The push button connects to the connecting means. Depression of the button is not possible when the locking element is engaged with the tongue by virtue of either lock being moved into the locked position.

Preferably, the front unit is formed with the tongue as a pure gravity latch which is mainly encased within a housing of the front unit.

The invention also extends to a front unit separately supplied and adapted to cooperate with a rear unit as described above and in any one of the forms described herein.

BRIEF DESCRIPTION OF DRAWINGS

For illustration only, an embodiment of the invention will now be described with reference to the accompanying drawing of which.

DETAILED DESCRIPTION OF DRAWINGS

Figure 1:
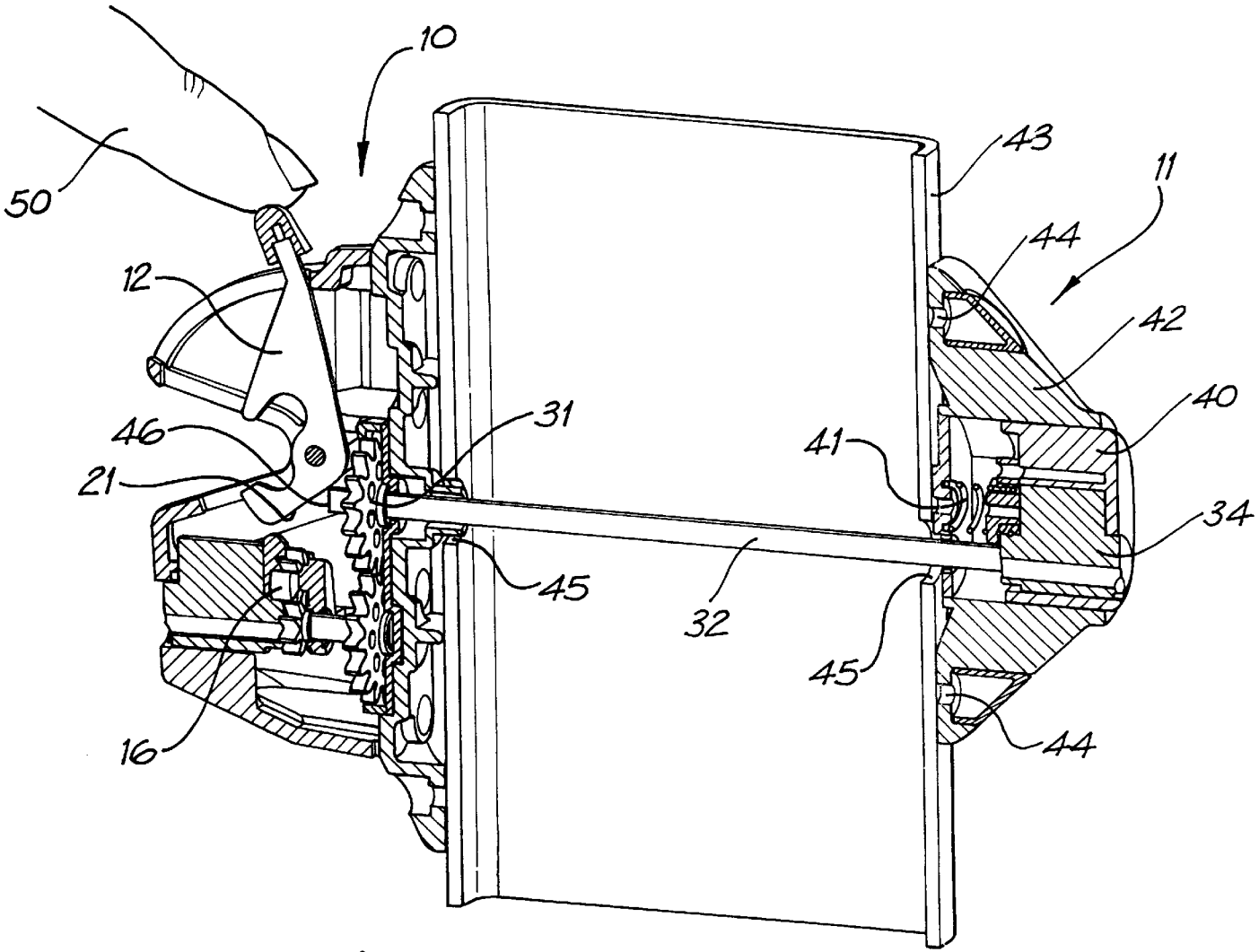
FIG. 1 is a cut-away drawing from the right partly in perspective view from the rear and showing front and rear units mounted on a gate post.

The embodiment shown will usually be described as a gravity latch which in this case comprises a front unit 10, a rear unit 11 and a horizontal striker pin (not shown) which usually is mounted on and projects from a gate or door. The striker pin moves in horizontal plane through an arc in order to engage with a latching tongue 12 within the front unit, the latching tongue having a pivot axle 13, and a centre of gravity laterally offset to the front so the tongue falls under its own weight to adopt the position shown in FIG. 2. The tongue 12 has a leading striker surface 14 which when impacted by a striker pin deflects the tongue upwardly to admit the pin into a recess 15, the tongue then falling to capture the pin whereby the gate or door cannot be open.

The principles of operation will first be described with reference to FIG. 3 where like reference numerals have been used for the components in FIGS. 1 and 2.

Figure 3:
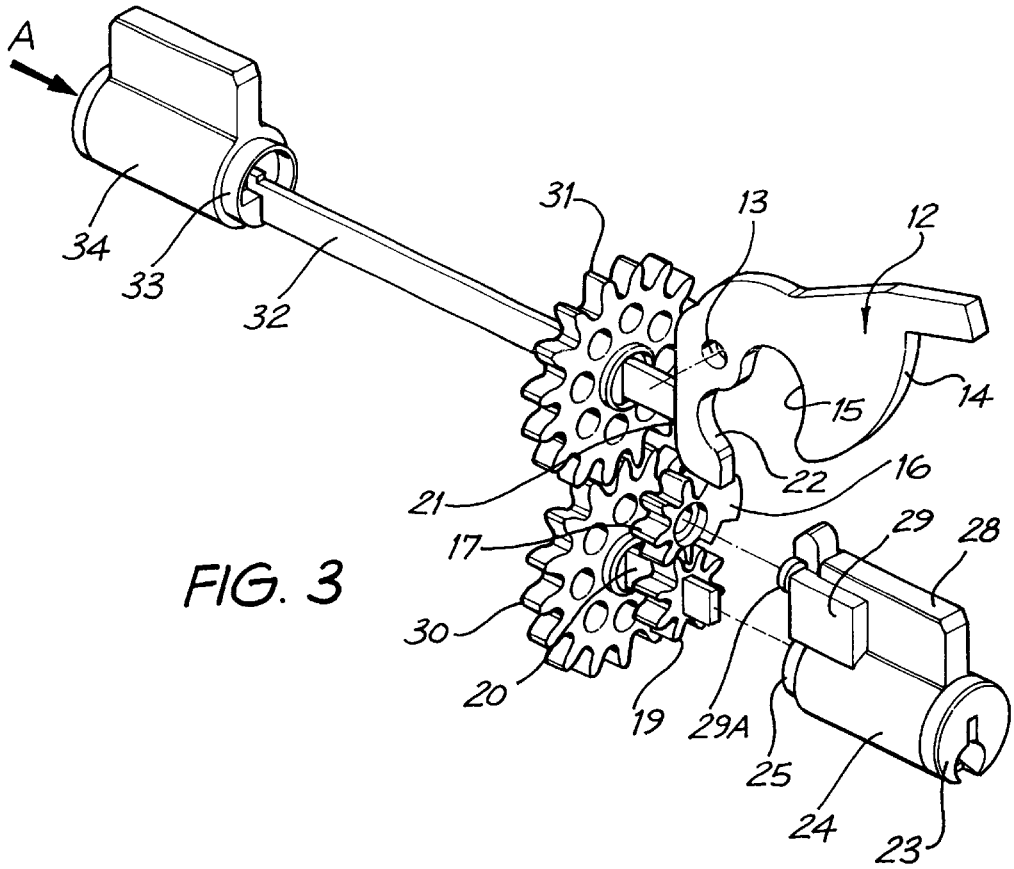
FIG. 3 is an exploded schematic sketch of the apparatus to illustrate the principles of construction and operation.

The schematic drawing of FIG. 3 shows the tongue in the upper position corresponding with FIG. 1, a position adopted by manual displacement of the tongue to the position in which the striker pin is released.

FIG. 3 shows schematically how locking and unlocking from either side of the structure is achieved. A wedge-shaped locking finger 16 is provided on a first rotationally mounted gear 17 which permanently engages with a second gear 19 which is adapted to be driven upon rotation of a flat bar 20. Thus, clockwise rotation of the bar 20 rotates the second gear clockwise and that rotates the first gear 17 anticlockwise to raise the locking finger 16 from the 3 o'clock to the 12 o'clock position when viewed as in FIG. 3. In this position, and since the tongue has been manually raised, the finger can engage behind a rear face 21 of the tongue to lock the tongue in the open position so that the gate does not latch in a closed position. Alternatively, when the tongue is in the lower position shown in FIG. 2, the finger 16 engages in front of the recess surface 22 of the tongue and thereby locks the tongue in the closed position. Usually this step is carried out after the gate has been closed.

Figure 4:
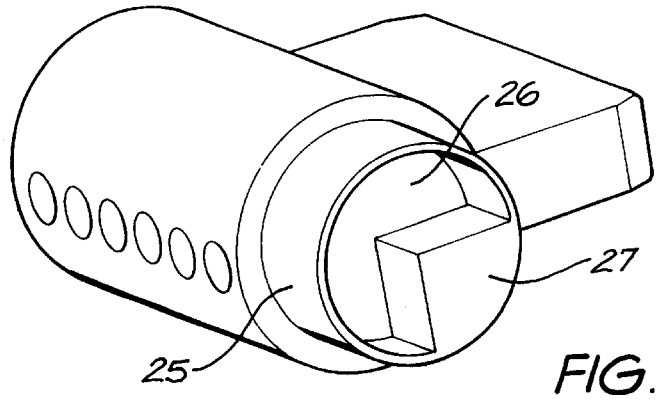
FIG. 4 is an enlarged sketch showing an apertured collar mounted to the rear of each lock cylinder and forming part of a lost-motion connection and rotated by rotation of a key in the lock.

Rotation of the drive bar 20 can be achieved by rotation of a key-actuated cylinder front lock 23 which has a barrel 24 fixedly mounted in a housing 51 (best shown in FIG. 2) and a rotatable apertured collar 25 which rotates when the key is turned. As shown in the scrap view of FIG. 4, viewing the lock from the rear, the collar 25 has a 270° cut-out or aperture 26 and a solid 90° segment 27. The end of the drive bar 20 extends diametrically across the cut-out 26 and axially along the cut-out with the bar vertical so that 90° of rotation of the key clockwise rotates the collar, and no motion to the drive bar occurs. A further 90° rotation of the key rotates the collar (which when viewed from the rear of the lock as in FIG. 4 rotates anti-clockwise) and this rotates the drive bar through 90° to a horizontal position whereby the locking finger 16 is moved to the 12 o'clock locking position.

Rotation of the drive bar 20 causes rotation of a third gear 30 on which the drive bar is mounted and supported. This rotation causes a fourth gear 31 to be rotated and thereby connecting bar 32 is rotated. The connecting bar 32 is similarly engaged in a collar 33 of the same form as collar 25 and associated with a rear cylinder lock 34. Rotation of the connecting bar 32 through 90° in an anticlockwise direction (as seen in FIG. 3) is a free motion by virtue of a cut-out in the collar 33 (similar to that shown in FIG. 4).

If desired, with the configuration shown in FIG. 3, the rear cylinder lock may be rotated clockwise when viewed from the rear in the direction of arrow A and motion is transmitted through the system to again raise the locking finger 16 to the 12 o'clock locking position.

FIG. 3 schematically illustrates in exploded view how the first gear 17 can be rotationally mounted. The cylinder lock 23 has a rectangular pin-containing casing 28 around which fits a mounting bracket 29 and from which a mounting pin 29A extends in order to rotationally mount the gear 17.

The system is such that when the locking finger 16 is in the 12 o'clock position, unlocking can occur by virtue either of the front or rear locking cylinders being actuated in the unlocking direction.

Although not shown in FIG. 3, the connecting bar 32 has a second function which will be explained with reference to FIG. 1. As shown in FIG. 1, the rear cylinder lock 34 is mounted in a corresponding moulded cavity in a push button 40, the button being spring-biased by a helical compression spring 41 to its outermost position as shown. The button 40 is retained by a circlip arrangement (not shown) within a moulded housing 42 which is secured to a gate post 43 by screws (not shown) inserted though preformed apertures 44. A clearance hole 45 is bored in front and rear walls of the post 43 to accommodate the connecting bar 32.

The leading tip 46 of the connecting bar 32 is disposed to engage the rear face 21 of the tongue 12 so as to push it to the displaced position shown in FIG. 1 whereby the striker pin is released. For this purpose, the connecting bar 32 is a sliding axial fit through the centre of the fourth gear 31. The third and fourth gears each have circular cross section bosses extending axially from the cut gear portion so that the gears are rotationally mounted through the bosses in a housing.

As shown in FIG. 1, when released, the push button 40 is retracted by the spring 41 and thus the tongue 12 is free to fall. FIG. 1 schematically shows the tongue held in the released position by a finger 50.

Figure 2:
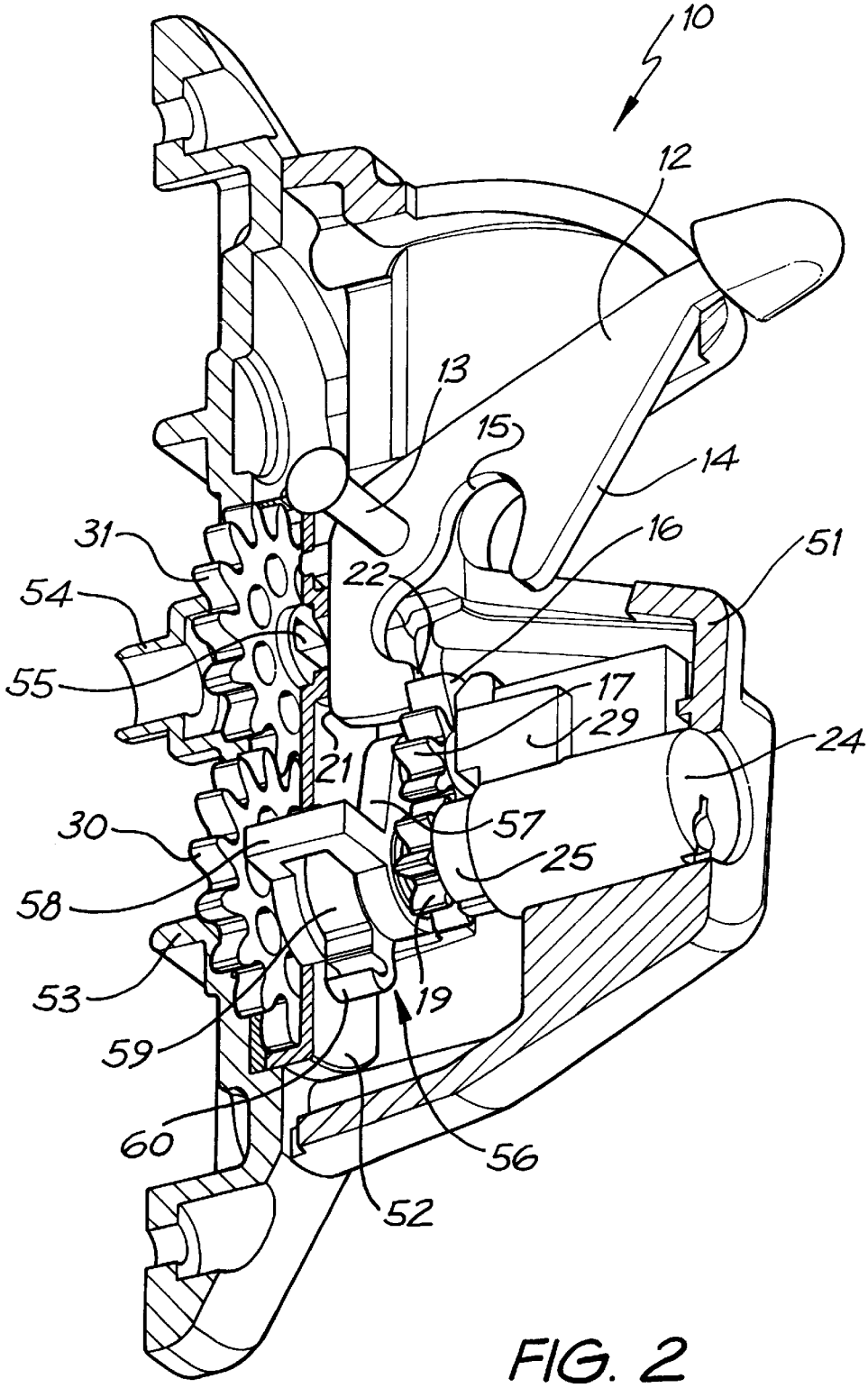
FIG. 2 is a perspective view from the left on an enlarged scale from in front and below of the front unit of the device shown in FIG. 1.

Details of the front unit are best seen in FIG. 2 which shows the locking position with the tongue 12 located behind .the locking finger 16. As shown in FIG. 2, the front lock barrel 24 is secured in a corresponding shape moulded cavity in a front housing 51 which has an inner rear wall 52 and an outer rear wall 53 and between which is a cavity for accommodating rotatably the meshed third and fourth gears 30 and 31. A rearwardly projecting central boss 54 is provided for engaging within the bored hole in the gate post and accommodating the connecting bar 32 (omitted from FIG. 2) which extends through a corresponding rectangular aperture 55 in the centre of the fourth gear 31 so that the leading tip 46 of the connecting bar can engage on the rear surface 21 of the tongue for raising the tongue when it is unlocked.

A mount 56 is provided for connection to the inner rear wall 52 and for rotationally supporting the first and second gears 17 and 19 through a forward wall portion 57 spaced forwardly by a pair of diametrically spaced spacer arms 58. Between the forward wall 57 and the inner rear wall 52 is provided a rotary stop element 59 having a stop arm 60 which, in the position shown in FIG. 2, engages with a detent (not shown) and which is fixedly mounted in the cut-away portion of the housing. This function positively fixes the position of the locking finger 16 in the 12 o'clock position, as well as giving the key operation a positive feel for locked and unlocked positions.

I claim:

1. A latch device for use with a gate, the latch device having front and rear units adapted to be mounted on opposite sides of a structure associated with the gate and against which the gate closes, (i) the front unit having (a) a first housing adapted to be mounted on the structure, (b) a manually displaceable latching tongue displaceably mounted in the housing and adapted to interengage with a striker pin mounted on the gate and for holding the striker pin in a closed position to prevent opening of the gate, (c) a locking element displaceably mounted in the housing for locking the tongue when in a locking position and displaceable to a retracted position in which the tongue is released, and (d) a key-activated front lock adapted to displace the locking element between its locking and retracted positions, (ii) the rear unit having (a) a second housing accommodating a key-actuated rear lock and (b) a displaceable element, (iii) the latch device having connection means (a) operable on actuation of either the front lock or the rear lock to displace the locking element between its locking and retracted positions (b) operable when the front lock or the rear lock is in an unlocked position to permit the displaceable element of the rear unit to act through the connection means to displace the tongue to release the striker pin and (c) including a rotatably displaceable mechanism for displacing the locking element through a lost-motion system which permits the displacement of the locking element to be achieved by operation of either the front lock or the rear lock;

(iv) the front and rear locks are cylinder locks each having a cylinder axis and the lost motion system includes a rotatable collar associated with each cylinder lock and mounted for rotation about the front and rear cylinder lock axis and including a cavity with a part-circular aperture extending approximately 270° around the front and rear cylinder lock axis and a wedge portion extending approximately 90° around the front and rear cylinder lock axis with flat faces at each end; and (v) connection means further comprises a first flat tip of the connection means for engaging in the cavity of the collar of the front lock to provide lost-motion for approximately 90° of rotation, and a second flat tip of the connection means for engaging in the cavity of the collar of the rear lock to provide lost motion, whereby either of the locks can be operated independently to displace the associated connection means and thus the locking element between the locked and retracted positions.

2. The latch device according to claim 1, wherein the front unit has meshing gear wheels, one of which carries the locking element and the other of which is adapted to be rotated upon rotation of the connecting means caused by the use of a key in either the front lock or the rear lock.

3. The latch device according to claim 1, wherein the connection means includes an elongate strip-like connector extending from the rear unit to the front unit along an axis offset laterally from the axis of the front lock, and the latch device having first and second connecting gears to provide rotary motion to be transmitted between the elongate connector and the rotatably displaceable mechanism.

4. The latch device according to claim 1, wherein the rear lock is mounted to be axially displaceable in the second housing, and the connection means includes an elongate strip-like connector which interconnects with the rear lock and is displaceable towards the front unit when the rear lock is manually displaced, a front portion of the connector-being displaceably mounted for engaging and displacing the tongue to release the striker pin when either of the locks are unlocked.

5. The latch device according to claim 1, wherein each of the first and second housings have means for mounting on respective sides of a gate post with the respective front and rear locks having a respective key entry face disposed on a face opposite to the face of the first and second housing which contacts the gate post when installed.

6. The latch device according to claim 1, wherein the connection means includes an elongate connecting element extending from the rear lock and adapted to be inserted and be movable within a bore drilled through the gate post to which the latch device is to be mounted.

7. The latch device according to claim 1, wherein the rear unit has a push button mounted for reciprocating motion in the rear housing and spring-biased to an outer position, the push button being connected to the connecting means for displacement to cause the tongue to move for releasing the striker pin, providing the tongue is not locked in the locked position.

8. The latch device according to claim 1, wherein the front unit mounts the tongue as a gravity latch, the tongue being substantially enshrouded in the first housing.

9. The latch device according to claim 1, wherein the connection means includes an elongate strip-like connector extending from the rear unit and adapted to be inserted and be movable within a bore drilled through the gate post to which the latch device is to be mounted.

10. The latch device according to claim 2, wherein the connection means includes an elongate connector extending from the rear unit to the front unit along an axis offset laterally from the axis of the front lock, and the latch device having first and second connecting gears to provide rotary motion to be transmitted between the elongate connector and the rotatably displaceable mechanism.

11. The latch device according to claim 10, wherein the rear lock is mounted to be axially displaceable in the second housing, and the elongate connector interconnects with the rear lock and is displaceable towards the front unit when the rear lock is manually displaced, a front portion of the connector being displaceably mounted for engaging and displacing the tongue to release the striker pin when either of the locks are unlocked, and wherein each of the first and second housings have means for mounting on respective sides of a gate post with the respective front and rear locks having a respective key entry face disposed on a face opposite to the face of the first and second housing which contacts the gate post when installed.

12. A latch device for a gate having a front unit adapted to be mounted on one side of a gate post and to interact with a latch striker pin mounted on a gate, the front unit having (a) a housing adapted to be mounted on the gate post, (b) a manually displaceable latching tongue displaceably mounted in the housing and adapted to interengage with a striker pin mounted on the gate and for holding the striker pin in a closed position to prevent opening of the gate (c) a locking element displaceably mounted in the housing for locking the tongue when in a locking position and displaceable to a retracted positionin which the tongue is released, (d) a key-activated front lock adapted to operate through connection means to displace the locking element between its locking and retracted positions, (e) the connection means including a rotatably displaceable mechanism for displacing the locking element through a lost-motion system which permits the displacement of the locking element to be achieved by operation of either the front lock or a rear lock of a rear lock unit with which the latch device is capable of being associated, (f) the front lock being a cylinder lock having a cylinder axis and the lost motion system including a rotatable collar mounted on the lock for rotation about the lock.axis and including a cavity with a part-circular aperture extending approximately 270° around the axis and a wedge portion extending approximately 90° around the axis with flat faces at each end and (g) the lost-motion system comprising a first flat tip of the connection means for engaging in the cavity of the collar of the front lock to provide lost-motion for approximately 90° of rotation, whereby the front unit is adapted to be connected to a rear unit having a housing accommodating a key-activated rear lock and a displaceable element for displaying the latching tongue, and the device being such that either of the locks can be operated independently to displace the associated connection means and thus locking element between the locked and retracted positions.

13. A latch device for use with a gate, the latch device having front and rear units adapted to be mounted on opposite sides of a structure associated with the gate and against which the gate closes, (i) the front unit having (a) a first housing adapted to be mounted on the structure, (b) a manually displaceable latching tongue displaceably mounted in the housing and adapted to interengage with a striker pin mounted on the gate and for holding the striker pin in a closed position to prevent opening of the gate, (c) a locking element displaceably mounted in the housing for locking the tongue when in a locking position and displaceable to a retracted position in which the tongue is released, and (d) a key-activated front lock, (ii) the rear unit having (a) a second housing accomodating a key-actuated rear lock and (b) a displaceable actuator, (iii) the latch device having connection means (a) operable on actuation of either the front lock or the rear lock to displace the locking element between its locking and retracted positions (b) operable when the front lock or the rear lock is in an unlocked position to permit the displaceable actuator of the rear unit to displace the tongue to release the striker pin and (c) including a rotatably disolaceable mechanism for displacing the locking element and a lost-motion system which permits the displacement of the locking element to be achieved by operation of either the front lock or the rear lock;

(iv) the front unit mounts the tongue as a gravity latch, the tongue being enshrouded in a housing, (v) the displaceable actuator includes a rotatably mounted elongate connector extending from the rear unit to the front unit along an axis offset laterally from the axis of the front lock, and the latch device having first and second connecting elements to provide rotary motion to be transmitted between the elongate connector and the connection means;

(vi) the displaceable actuator further having axially displaceable means for engaging and displacing the tongue to release the striker pin when either of the locks are unlocked and the displaceable actuator is displaced in the second housing.

14. The latch device according to claim 13, wherein the lost motion system includes a rotatably mounted barrel associated with ear lock and rotatable responsive to a key turning in that lock, the lock of the rear unit being connected through a lost motion connection to the displaceable actuator and the barrel of the front lock being connected through a lost motion connector of complementary character to the connection means, whereby either of the locks can be rotated to displace the locking element between locking and retracted positions independently of the other lock.

15. The latch device according to claim 13, wherein each of the first and second housings have means for mounting on respective sides of a gate post with respective front and rear locks having a key entry face disposed on a face opposite to the face of the first and second housing which contacts the gate post when installed.

16. The latch device according to claim 13, wherein the front unit has meshing gear wheels, one of which carries the locking element and the other of which is adapted to be rotated upon rotation of key rotation of the front lock or the rear lock.

17. The latch device according to claim 13, wherein the rotatably mounted elongate connector is axially displaceable against spring biasing operatively provided in the rear housing for displacing the tongue of the gravity latch.

18. The latch device according to claim 17, wherein the elongate connector is strip-like and the first connecting element is a gear wheel mounted on the elongate connector but in an axially displaceable manner and the second connecting element is a complementary gear wheel to transmit a rotary motion to a mounting shaft of the connection means.

19. A latch device for use with a gate, the latch device having front and rear units adapted to be mounted on opposite sides of a structure associated with the gate and against which the gate closes, (i) the front unit having (a) a first housing adapted to be mounted on the structure, (b) a manually displaceable latching tongue displaceably mounted in the housing and adapted to interengage with a striker pin mounted on the gate and for holding the striker pin in a closed position to prevent opening of the gate, (c) a locking element displaceably mounted in the housing for locking the tongue when in a locking position and displaceable to a retracted position in which the tongue is released, and (d) a key-activated front lock adapted to displace the locking element between its locking and retracted positions, (ii) the rear unit having (a) a second housing accommodating a key-actuated rear lock and (b) a displaceable actuator spring biased to an outer position, (iii) the latch device having connection means (a) operable on actuation of either the front lock or the rear lock to displace the locking element between its locking and retracted positions (b) operable when the front lock or the rear lock is in an unlocked position to permit the displaceable actuator to displace the tongue to release the striker pin and (c) including a rotatably displaceable mechanism for displacing the locking element and a lost-motion system which permits the displacement of the locking element to be achieved by operation of either the front lock or the rear lock;

(iv) the front unit mounts the tongue as a gravity latch, the tongue being enshrouded in housing;

(v) the displaceable actuator includes a rotatably mounted and axially displaceable elongate connector extending from the rear unit to the front unit along an axis offset laterally from the axis of the front lock, a leading tip of the connector being mounted to engage and displace the tongue to an open position when the displaceable actuator is urged from its outer position, (vi) the latch device having connecting gears to provide rotary motion to be transmitted between the elongate connector and the rotatably displaceable mechanism;

(vii) each of the locks is a cylinder lock having a cylinder axis at right angles to the face of the housings adapted to about the structure, the respective cylinder axes of the locks being parallel and laterally offset relative to one another, (viii) the locking element is mounted on a rotatable gear element engaged with a driven gear element forming part of the connection means, and (ix) the lost motion system includes a rotatable barrel connected to the rear cylinder lock for engagement with the elongate connector and providing approximately 90° freedom of rotation in one direction, and a rotatable barrel connected to the front cylinder lock for engagement with a connector on which the driven gear element is mounted and providing approximately 90° of freedom of rotation in a direction complementary to the freedom of rotation provided at the rear lock.

* * * * *